US005484455A

United States Patent [19]

Kelley

[11] Patent Number: 5,484,455

[45] Date of Patent: Jan. 16, 1996

[54] CATIONIC DYEABLE NYLON DYED WITH VINYL SULFONE DYES TO GIVE OVERDYE FASTNESS

[75] Inventor: Larry C. Kelley, Dalton, Ga.

[73] Assignee: Hoechst Celanese Corporation, Somerville, N.J.

[21] Appl. No.: 249,493

[22] Filed: May 26, 1994

[51] Int. Cl.[6] ..... D06P 3/10; C09B 62/503

[52] U.S. Cl. ..... 8/539; 8/549; 8/924

[58] Field of Search ..... 8/539, 549, 924

[56] References Cited

U.S. PATENT DOCUMENTS 5,089,667 2/1992 Jenkins et al. ..... 8/539

5,131,918 7/1992 Kelley ..... 8/549

5,199,958 4/1993 Jenkins et al. ..... 8/539

5,350,426 9/1994 Jenkins ..... 8/539

*Primary Examiner*—Margaret Einsmann

*Attorney, Agent, or Firm*—Hugh C. Crall

[57] ABSTRACT

A process for dyeing cationic polyamide with a vinyl sulfone dye wherein said vinyl sulfone dyed polyamide is color stable. The vinyl sulfone dyed cationic polyamide may be overdyed with acid without staining the dyed cationic nylon.

4 Claims, No Drawings

CATIONIC DYEABLE NYLON DYED WITH VINYL SULFONE DYES TO GIVE OVERDYE FASTNESS

BACKGROUND OF THE INVENTION

1. Technical Field

This invention relates to the dyeing of cationic nylon with fiber reactive vinyl sulfone type dyes.

2. Background of the Invention

For years attempts have been made to produce a printed nylon yarn by space dyeing and other techniques which could be tufted into carpet and maintain its color integrity during subsequent dyeing operations. Space dyeing, i.e. the dyeing or printing of a knitted fabric is well known in the art. Such attempts have been generally unsuccessful due to two problems. First, the acid dyes which they use to print the yarn migrate off the substrate into the dyebath at the boiling temperatures and redeposit on the greige yarn. For example, if a dark blue shade was space dyed onto a yarn that was then tufted into greige carpet and finally overdyed a pale yellow shade, some of the blue acid dye will cross stain the yellow base shade and produce a greenish shade. The second problem was that the monosulfonated acid dyes normally used to dye solid carpet shades will also cross dye the space dyed area. An example of this would be a pale blue shade on the space dyed yarn which was implanted in a carpet that was overdyed a dark red shade. The red acid dye, chosen for its migration power, will also dye unoccupied dye sites in the blue printed areas and shift the blue to a purple shade.

Attempts to overcome these problems have included the use of premetalized acid dyes, fixing agents, low temperature and low pH dyeing cycles, light acid dyeable nylon, Suessen heat setting, etc. The most commonly used system consists of a combination of the premetalized acid dyes and sulfonated phenol formaldehyde condensates, which are the typical acid dye fixing agents. The premetalized dyes are large molecules which are not very mobile and do not tend to migrate from the printed area onto the greige carpet during overdyeing. The phenol formaldehyde fixing agents form a shield or film around the fiber which prevents the print or space dyed colorant from migrating and also inhibits the cross dyeing of the base shade into the printed area. This approach has been somewhat successful in continuous overdyeing applications, but it fails in exhaust dyeing applications where the substrate is held at the boil for 30–60 minutes. An additional problem with premetalized acid dyes is that they are limited in their range of shades and are usually dull in cast, which prevents the achievement of bright yellows, reds, blues, and greens.

There have also been systems where the exhaust overdyeing was carded out at low temperatures (160°–180° F.) and low pH (4.0–5.0)in order to limit the migration from the printed area. The problem with this approach was that the overdye shade was often unlevel, and attempts to repair it by raising the pH or temperature caused the print dyes to migrate off the fabric into the substrate dyebath. Other approaches include the use of the premetalized dyes and fixing agents with light dyeable nylon and Suessen heat setting. The cross staining of the overdye shade is reduced because the light dye nylon has fewer dye sites and Suessen heat setting destroys dye sites, but this process gives unacceptable results in exhaust overdye situations.

Several years ago, a system was perfected where vinyl sulfone dyes could be used to space dye nylon so that total overdye fastness was achieved. The vinyl sulfone dye was first pretreated with alkali to convert the ester into the vinyl group, and then it was printed and steamed on the acid side forming an ionic bond with the amine end groups of the nylon. After washing the printed nylon was dipped into alkali, dried, and heat set. When the vinyl sulfone dyes undergo heat setting under alkaline conditions, they will form a reactive or covalent bond with the amine groups. Since the vinyl sulfone dyes formed a reactive bond with the nylon, they will not migrate from the space dyed areas even under the most severe dyeing conditions such as exhaust dyeing under pressure. Therefore, this process solved half of the space dye/overdye problems, but difficulties with cross dyeing were still encountered. When regular dye nylon was printed with the vinyl sulfone dyes, all of the available dye sites could never be quite fully occupied, so if a blue shade was overdyed on carpet containing the space dyed yarn, the print shades would always be shifted to the blueside and appear duller in cast. Fixing agents cannot be used with the vinyl sulfone dyes so it was not possible to form a film barrier around the printed areas which would resist the cross staining to a degree.

To overcome the cross staining or cross dyeing of the space dyed area, the use of cationic dyeable nylon was investigated. Cationic dyeable nylon is made by incorporating $SO_3$ groups into the polymer (U.S. Pat. No. 3,542,743) in a number sufficient to render the nylon dyeable with basic dyes. However, there are still a certain number of amine end groups left in the cationic dyeable nylon that remain receptive to acid type dyes and cross staining is a problem.

SUMMARY OF THE INVENTION

This invention is a method for dyeing cationic nylon which can be overdyed with acid dyes without cross staining the dyed cationic nylon. The process comprises applying a previnylized vinyl sulfone dye to the cationic nylon at a low pH. The dyed cationic nylon is then treated with an alkali to increase the pH to about 10 and heated to dry and fix the vinyl sulfone dye to the substrate by covalent bonding. The vinyl sulfone dye may be applied by printing, continuous or exhaust dyeing procedures. The treated cationic nylon can be incorporated into an anionic nylon substrate (e.g. tufted into carpet) which is then overdyed with standard acid dyes. The acid dyes will not stain or migrate into the cationic fiber and the vinyl sulfone dye will not migrate into the anionic fiber.

DESCRIPTION OF THE PREFERRED EMBODIMENTS

Acid dyeable polyamide fibers (anionic polyamide) and basic dyeable polyamide fibers (cationic polyamide) are well known in the textile and carpet art. These fibers can be knitted, woven or tufted into a substrate in a manner such that a defined or random pattern is achieved. It is the object of this invention to achieve multi-colored dyeings of such mixed anionic/cationic polyamide substrates without cross-staining or dyeing the cationic fibers with acid dye colorant.

Acid dyeable polyamides are unmodified polyamides in which the functional groups in the polymer chain are cationic ($—NH_2$) and capable of forming an ionic bond with a dye containing anionic functional groups ($—SO_3X$, where X is hydrogen or a cation). In basic dyeable polyamides the functional groups in the polymer chain are artionic ($—SO_3X$ or —COOX) and dyeable with a dye containing cationic groups.

Theoretically, it should be possible to dye the anionic fibers of a mixed anionic/cationic fiber substrate with an acid or anionic dye without staining or dyeing the cationic fibers of the substrate. Likewise, it should be theoretically possible to dye the cationic fibers with a basic dye without staining or dyeing the anionic fibers of the mixed fiber substrate. However, in practice, the commonly used acid dyes will stain and dye cationic polyamide fibers. Although, the acid dye does not build as strong a shade on the cationic fiber as it does on the anionic fiber, the amount of color build up can be significant. This invention avoids the problem of undesired secondary staining or dyeing of a fiber in a mixed anionic-cationic polyamide substrate.

The fiber-reactive, vinyl sulfone type dyes useful in the practice of the invention are well known. The main use of such fiber-reactive, vinyl sulfone type dyes has been in the dyeing of cotton. However, U.S. Pat. Nos. 3,802,837 and 4,762,524 teach their use in the dyeing of polyamides. These prior art references teach to use the vinyl sulfone dye as a reaction product with a substituted, secondary, aliphatic amine such as n-methyltaurine.

The following patents illustrate that the vinyl sulfone type dyes are well known:

U.S. Pat. No. 4,336,190 (formazon)

U.S. Pat. No. 4,492,654 (disazo);

U.S. Pat. No. 4,046,754 (monoazo);

U.S. Pat. No. 4,577,015 (dioxazine);

U.S. Pat. No. 3,359,286; 4,049,656 (anthraquinone);

U.S. Pat. No. 3,268,548 (phthalocynine) and;

U.S. Pat. No. 3,385,843 (pyrazolone).

The teachings of the above cited patents are hereby incorporated by reference.

Dyes of the vinyl sulfone type may be represented by the following general formula:

$$(SO_3M)_m—D—(SO_2—Z)_n$$

In the above formula, "D" represents a dye chromophore selected from the anthraquinone, dioxazine, formazon, phthalocyanine, mono- and disazo series and their metal complexes wherein the metal is selected from copper, chromium, iron, cobalt and nickel; preferably copper or nickel. Particularly preferred are those chromophores of the mono- and disazo series and their metal complexes. "Z" represents the fiber reactive groups: $—CH=CH_2$ and $—CH_2—CH_2—Y$ wherein "Y" is a substituent capable of being split off by an alkaline reagent: e.g., chlorine, bromine, thiosulfate, sulfato, phosphato, a carboxylic acyloxy of one to four carbon; or by an acidic reagent: e.g., dimethylamino, diethylamino, N-alkyl ($C_1$ to $C_4$)-amino-alkyl ($C_1$ to $C_4$) sulfonic or carboxylic acids ($C_1$ to $C_4$). The sulfato group is preferred. The term "n" represents an integer from 1 to 3. The term "m" represents an integer from 1 to 4. The term "M" represents hydrogen and the metals sodium, potassium, lithium or calcium; preferably sodium. The dye chromophore may contain additional fiber reactive groups: e.g. a mono- or di-halogen-s-triazine, a mono cyanamido-s-triazine, a mono-, di- or tri- halogen pydmidine, a mono or dichloroquinoxaline, a dichlorophthalazine, a dichloropyridazone or the bromine or fluorine derivatives thereof. As used in this description and the claims hereto, the term "vinyl sulfone group" or "vinyl sulfone substituent" means the group $—(SO_2—Z)$.

Not every vinyl sulfone dye can be used to dye the cationic dyeable nylon because this fiber has such a low affinity for such dyes. Vinyl sulfone dyes with two or more sulfo ($SO_3$) groups have too low of an affinity for the cationic nylon and will do no more than stain the fiber. However, vinyl sulfone dyes with only one ($SO_3$) sulfo group and one or two reactive groups (vinyl sulfone moieties and/or halotriazines) possess sufficient affinity and will dye the cationic nylon in a pale to medium shade. For the purpose of this description such dyes are designated Group I dyes. Vinyl sulfone dyes having two sulfo groups are designated Group II vinyl sulfone dyes and those contain three or more sulfo groups or two sulfo groups and a cyanamide group are designated Group III vinyl sulfone dyes. It has also been found that blocking effects occur due to the low dyeability of the cationic dyeable nylon so the vinyl sulfone dyes must be screened to find the proper combination.

Vinyl sulfone dyes are normally used in the dyeing of cotton in their ester form; i.e. the moiety "Z" is $—CH_2—CH_2—Y$ where Y is the sulfato ester ($OSO_3M$) form. In the invention the vinyl sulfone substituent is employed in the vinyl form; i.e. $Z=—CH=CH_2$. The vinyl sulfone dyes must be converted from their normal ester form to the vinyl form for use according to this invention. This is accomplished by adding alkali to the dissolved dye. The procedure for previnylizing the vinyl sulfone dye is known. The dye is dissolved in hot water (160°–190° F.) under agitation and mixed for 5–10 minutes to ensure dissolution. Alkali is added to the dye solution at 160°–180° F. Generally trisodium phosphate (TSP) and soda ash are used to provide the alkaline conditions necessary to vinylize the dye from the ester form to the vinyl form. Approximately 0.1 to about 0.35 parts of trisodium phosphate (TSP) per part of dye and about 0.04 to about 0.2 parts of soda ash per part of dye are used to effect vinylization of the ester to the vinyl group. The amount of trisodium phosphate and alkali will vary depending on the dye. The correct amount of each is determined by simple experimentation. When the vinyl sulfone dyes is in its vinyl form, it has greater affinity for the cationic nylon and will more readily react with the amine end groups. The previnylized dye is then reacted with the fiber in a two step process. First, the dye is printed or exhaust dyed at an acidic pH to form an ionic bond, and then the dyed fiber is given an alkali rinse, followed by drying and heat setting to form a covalent bond.

In printing the cationic fiber, the pH of the print solution is adjusted to between 1.5–3.0 by using sulfamic or phosphoric acid. Normal guar bean thickeners can be used, and nonionic wetters are preferred. Hexametaphosphate sequesterants and sodium thiosulfate anichlors can be added if needed. Anionic wetters or leveling agents will cause blocking effects and should be avoided. Steaming times are from 1–8 minutes followed by rinsing or washing to remove excess dye and residual acid. An alkali (TSP, soda ash, NaOH) solution is then applied to the yarn in the amount necessary to raise the pH to between 9.0–10.5. If the pH is not at least 9.0, the reaction of the vinyl sulfone dye with the amine end groups is reduced, and part or all of the shade will be lost during the overdye cycle. After the alkali is applied, the yarn is dried, and then it is heat set (Autoclave, Suessen, or Superba techniques). During the heat setting operation the vinyl sulfone dye will react with the amine end groups forming a covalent bond.

If the vinyl sulfone dyes are exhaust dyed, the application conditions are similar. The pH is held to 2.0–3.0 and no anionic levelers or wetters are used. The dyeing is taken to the boil and held for about 20 minutes, followed by a rinse and a 2% owf TSP dnse for 10 minutes at 80 F. After drying the yarn is heat set as above.

After the cationic yarn (dyed with the vinyl sulfone dyes) has been heat set, it can be tufted into greige carpet (anionic nylon carpet) and overdyed by printing, continuous, atmospheric exhaust, or pressure exhaust methods with no loss of the shade. If a pale shade is to be overdyed, the normal acid dyes can be used. However, in heavier shades the acid dyes can cross stain the space dyed yarn to some extent. Group II vinyl sulfone dyes (ester form) with two sulfonic acid groups or reserving acid dyes can be employed in the dark shades, and they will minimize cross staining. If the Group II vinyl sulfone dyes are used, it is possible to dye even a black shade with no stain over on the dyed cationic nylon.

The following dye structures and corresponding dye designations are used in the following examples. The dyes are shown in their free acid and sulfatoethylsulfone form.

YELLOW 1 DYE

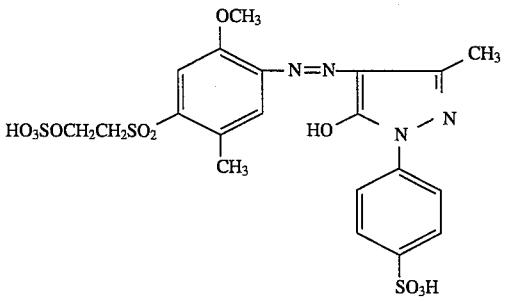

YELLOW 2 DYE

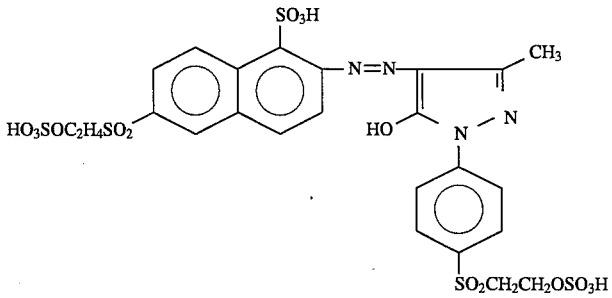

YELLOW 3 DYE

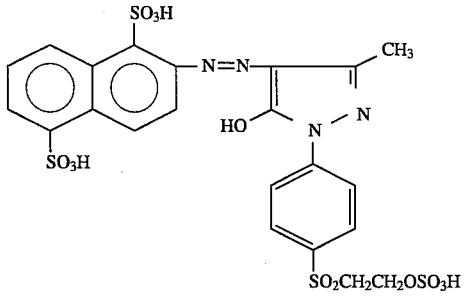

RED 1 DYE

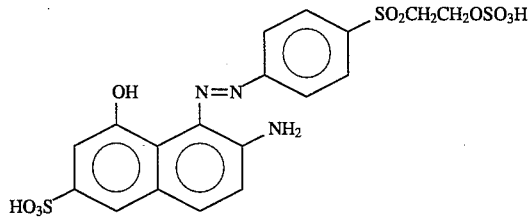

RED 2 DYE

-continued
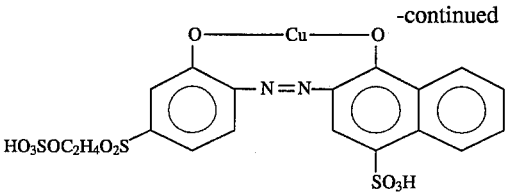
RED 3 DYE
A mixture of Red 1 and
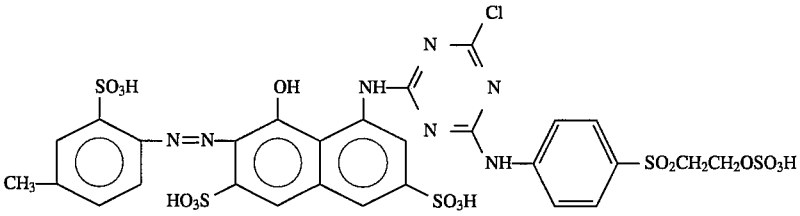
BLUE 1 DYE
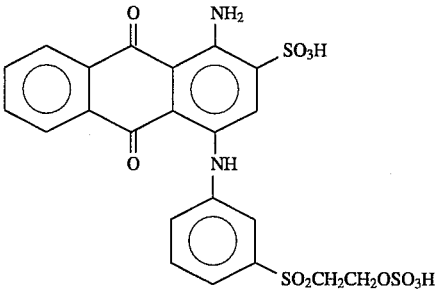
BLUE 2 DYE
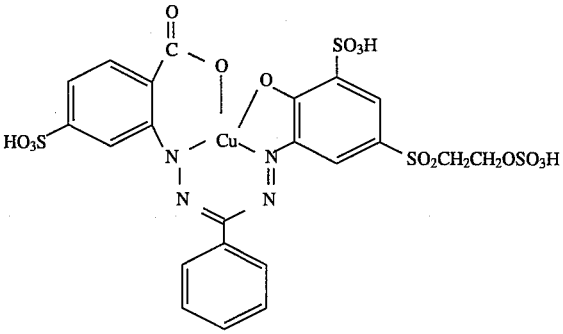
BLUE 3 DYE
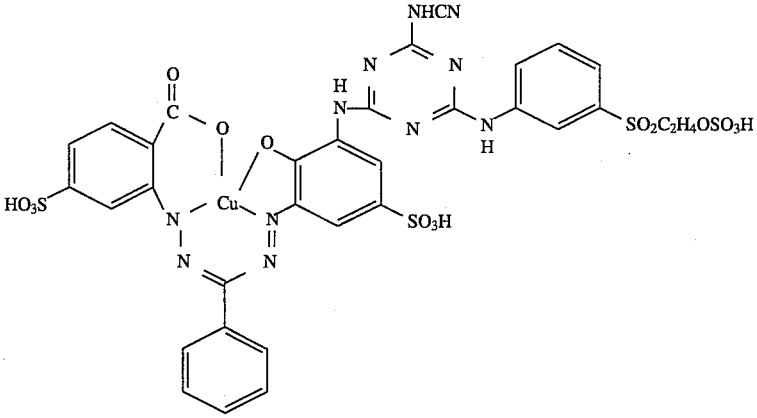

BLACK 1 DYE

-continued

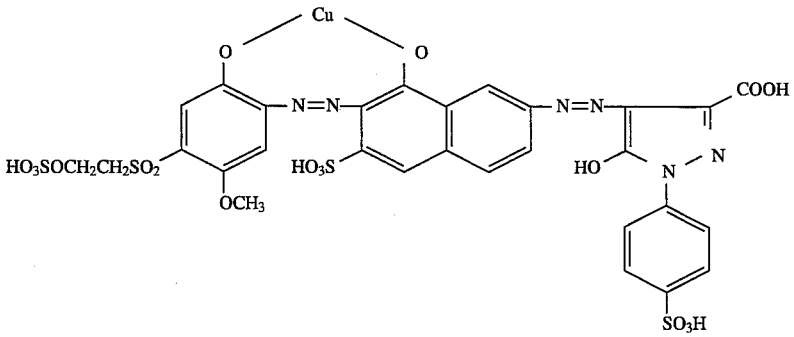

EXAMPLE 1

Prints were made on knit tube comprised of Dupont type 494A cationic dyeable 66 nylon with blue dyes selected from the Group I, II, and III vinyl sulfone dyes in their sulfato ester form. The printing paste formulas were:

| | | |
|---|---|---|
| A. | 5.0 g/l | Blue 1 Dye (Group I) |
| | 6.0 g/l | Guar thickener |
| | 0.5 g/l | Hostapur CX (nonionic wetter) |
| | 3.0 g/l | Sulfamic acid pH 1.8–2.0 |
| B. | 5.0 g/l | Blue 2 Dye (Group II) |
| | 6.0 g/l | Guar thickener |
| | 0.5 g/l | Hostapur CX (nonionic wetter) |
| | 3.0 g/l | Sulfamic acid pH 1.8–2.0 |
| C. | 5.0 g/l | Blue 3 Dye (Group III) |
| | 6.0 g/l | Guar thickener |
| | 0.5 g/l | Hostapur CX (nonionic wetter) |
| | 3.0 g/l | Sulfamic acid pH 1.8–2.0 |

These samples were printed, steamed 8 minutes, rinsed, and dried. The Group I (Blue 1) dye print was a pale to medium blue; the Group II (Blue 2) dye was a very pale blue; and the Group III (Blue 3) dye was washed out in the rinse.

The above three dyes were printed in the same manner as above except that the dyes were used in the vinyl form. The Blue 1 dye produced a good medium to heavy blue dyeing twice the depth of the ester form dyeing. The Blue 2 dye and Blue 3 dyeings were only pale shades of blue. This example shows that Group I vinyl sulfone dyes in the vinyl form with one sulfo ($SO_3$) substituent have sufficient affinity to dye the cationic nylon.

EXAMPLE 2

Prints were made on the Dupont 494A cationic dyeable nylon using Group I vinyl sulfone dyes in their ester and vinyl(PV) form. The printing paste formulas were:

| | | |
|---|---|---|
| A. | 5.0 g/l | Yellow 1 Dye |
| | 6.0 g/l | Guar thickener |
| | 0.5 g/l | Hostapur CX wetter |
| | 3.0 g/l | Sulfamic acid |
| B. | 5.0 g/l | Yellow 1 Dye (previnylized) |
| | 6.0 g/l | Guar thickener |
| | 0.5 g/l | Hostapur CX wetter |
| | 3.0 g/l | Sulfamic acid |
| C. | 5.0 g/l | Yellow 2 Dye |
| | 6.0 g/l | Guar thickener |
| | 0.5 g/l | Hostapur CX wetter |

-continued

| | | |
|---|---|---|
| | 3.0 g/l | Sulfamic acid |
| D. | 5.0 g/l | Yellow 2 Dye (PV) |
| | 6.0 g/l | Guar thickener |
| | 0.5 g/l | Hostapur CX wetter |
| | 3.0 g/l | Sulfamic acid |
| E. | 5.0 g/l | Red 1 Dye |
| | 6.0 g/l | Guar thickener |
| | 0.5 g/l | Hostapur CX wetter |
| | 3.0 g/l | Sulfamic acid |
| F. | 5.0 g/l | Red 1 Dye (PV) |
| | 6.0 g/l | Guar thickener |
| | 0.5 g/l | Hostapur CX wetter |
| | 3.0 g/l | Sulfamic acid |
| G. | 5.0 g/l | Red 2 Dye |
| | 6.0 g/l | Guar thickener |
| | 0.5 g/l | Hostapur CX wetter |
| | 3.0 g/l | Sulfamic acid |
| H. | 5.0 g/l | Red 2 Dye (PV) |
| | 6.0 g/l | Guar thickener |
| | 0.5 g/l | Hostapur CX wetter |
| | 3.0 g/l | Sulfamic acid |

These dyeings were printed, steamed 8 minutes, rinsed, and dried. In all cases the vinyl form of the dyes gave at least twice the color yield of the ester form.

Next, the combinatodal properties of the Group I vinyl sulfone dyes were examined using the same procedure as described above. All of the dyes in the following formulas were used in their vinyl form.

| | | |
|---|---|---|
| I. | 1.0 g/l | Yellow 1 Dye |
| | 1.0 g/l | Red 1 Dye |
| | 3.0 g/l | Blue 1 Dye |
| J. | 1.0 g/l | Yellow 2 Dye |
| | 1.0 g/l | Red 1 Dye |
| | 3.0 g/l | Blue 1 Dye |
| K. | 2.5 g/l | Yellow 1 Dye |
| | 2.5 g/l | Blue 1 Dye |
| L. | 2.5 g/l | Yellow 2 Dye |
| | 2.5 g/l | Blue 1 Dye |
| M. | 0.5 g/l | Yellow 1 Dye |
| | 3.5 g/l | Red 1 Dye |
| | 0.5 g/l | Blue 1 Dye |
| N. | 0.5 g/l | Yellow 2 Dye |
| | 3.5 g/l | Red 1 Dye |
| | 0.5 g/l | Blue 1 Dye |

The prints were steamed and washed in the normal manner. The results were that in all the shades containing the Yellow 1 dye, the yellow color was blocked and washed out, In the combinations with Yellow 2 dye a medium depth shade of blue, green and rose was obtained.

EXAMPLE 3

On a production space dye range, four shades were sprayed onto Monsanto type JBJ cationic dyeable 66 nylon yarn. The prints were then steamed 1.5 minutes, followed by a water rinse and then another rinse containing 20 g/l of TSP. The yarn was dried and then plied with a Monsanto type KEJ anionic nylon 66. Heat setting was carried out by the autoclave process.

| The print shades were as follows: | | |
|---|---|---|
| A. | 5.0 g/l | Yellow 2 Dye (PV) |
| | 3.0 g/l | Sulfamic acid |
| B. | 4.0 g/l | Red 1 Dye (PV) |
| | 3.0 g/l | Sulfamic acid |
| C. | 2.0 g/l | Yellow 2 Dye (PV) |
| | 3.0 g/l | Blue 1 Dye (PV) |
| | 3.0 g/l | Sulfamic acid |
| D. | 4.0 g/l | Blue 1 Dye (PV) |
| | 3.0 g/l | Sulfamic acid |

The heat set, cationic yarn was then tufted into a carpet form along with Monsanto KEJ anionic. A pattern was made by use of a graphics type tufting machine so that the cationic dyed end comprised 20% of the total carpet. A blank exhaust overdye cycle was then run on this carpet using: 1.0% owf Sandogen NH (cationic/nonionic leveler) and an alkaline solution of monosodium phosphate and tdsodium phosphate. The bath was adjusted to a pH of 6.5–7.0 and maintained for 20 minutes at the boil.

The result was that the greige portion of the carpet was stained only a very pale blue which indicates that the vinyl sulfone dyes almost fully reacted with amine end groups and no longer migrate during a dyeing cycle.

Next, overdye shades were made on the same carpet using monosulfonated acid dyes and Group II vinyl sulfone dyes in their ester form.

| | |
|---|---|
| Teal Green | 0.27% owf Yellow 3 |
| | 1.10% owf Blue 2 |
| | 1.00% owf Sandogen NH |
| | pH 4.5 and 20 minutes at boiling |
| Forest Green | 0.56% owf Cl Acid Yellow 246 200% |
| | 0.06% owf Cl Acid Red 361 200% |
| | 0.72% owf Cl Acid Blue 277 200% |
| | 1.00% owf Sandogen NH |

The dyeing conditions were pH 6.5 and 20 minutes at boiling. The vinyl sulfone dyes totally reserved the cationic space dyes yarn making a teal green field with bright yellow, red, green, and blue areas of space dye yarn visible and unstained. The acid dyes also reserved on the space dyed yarn, but a small amount of cross dyeing was noticeable.

EXAMPLE 4

Another series of experiments were run on a Superba space dye range where Monsanto JBJ cationic nylon was spray printed followed by 1 minute steaming and a subsequent application of 25 g/l of TSP before drying. The space dyed yarn, which had been dyed in the plied form, was then Superba heat set.

| Print formulas: | | |
|---|---|---|
| Yellow | 5.6 g/l | Yellow 2 Dye (PV) |
| | 1.0 g/l | Defoamer |
| | 3.0 g/l | Phosphoric acid 70% pH 1.6–2.0 |
| Green | 2.6 g/l | Yellow 2 Dye (PV) |
| | 2.2 g/l | Blue 1 (PV) |
| | 1.0 g/l | Defoamer |
| | 3.0 g/l | Phosphoric acid 70% pH 1.6–2.0 |
| Red | 3.5 g/l | Red 1 Dye (PV) |
| | 1.0 g/l | Defoamer |
| | 3.0 g/l | Phosphoric acid 70% pH 1.6–2.0 |
| Violet | 3.5 g/l | Red 2 Dye (PV) |
| | 1.0 g/l | Defoamer |
| | 3.0 g/l | Phosphoric acid 70% pH 1.6–2.0 |
| Blue | 3.5 g/l | Blue 1 Dye (PV) |
| | 1.0 g/l | Defoamer |
| | 3.0 g/l | Phosphoric acid 70% pH 1.6–2.0 |

After the yarn was heat set, it was knitted into a tube, and 5 grams of the tube and 15 grams of regular dye greige carpet were overdyed in a blank bath. A small amount of red stain was seen on the greige carpet, but still most of the dye remained on the dyed cationic vinyl sulfone yarn indicating that reaction had occurred. A black shade was overdyed in the same manner:

0.35% owl Yellow 3 Dye 0.05% owl Red 3 Dye 1.05% owf Black 1 Dye 1.00% owl Lanagen EP*

*An ethoxylated alcohol, nonionic level agent (Lenmar Chemical, Dalton, Ga.)

Dyeing conditions—pH 4.5 and 20 minutes at boiling

The result was a full black shade on the greige carpet and the colors on the space dye tube remained as they were before dyeing.

EXAMPLE 5

Skeins of Monsanto JBJ cationic nylon were exhaust dyed with vinyl sulfone dyes. The skeins were split into two portions; one portion was given an alkaline rinse before drying, the other a water rinse. The two skeins, a coral and a mauve, were plied together before heat setting in the autoclave. After heat setting, the yarn was tufted into carpet along with regular dye (anionic) Monsanto KEJ yarn which was then blank overdyed and overdyed a navy shade.

| | |
|---|---|
| Coral | 0.25% owf Yellow 2 (PV) |
| | 0.25% owf Red 1 (PV) |
| | 1.00% owf Sulfamic acid |
| Dyeing condition - pH 2.0 and 20 minutes at boiling | |
| Mauve | 0.25% owf Red 1 (PV) |
| | 0.25% owf Blue 1 (PV) |
| | 1.00% owf Sulfamic acid |
| Dyeing condition - pH 2.0 and 20 minutes at boiling | |
| Alkaline | 2.0% owf TSP |
| | Run 10 min at 80° F. |

The blank overdyeing, carded out as in the above examples, showed that the skeins which had been given the alkaline rinse before heat setting lost a small amount of color; while the skeins rinsed in water lost 80–90% of their color. The navy shade was overdyed on the alkaline treated yarn and showed good results.

I claim:

1. A process for dyeing cationic polyamides which comprises applying a previnylized vinyl sulfone dye to said polyamide at an acidic pH to form an ionic bond between said vinyl sulfone dye and the amino groups of said polyamide wherein said vinyl sulfone dye contains only one sulfo substituent; applying an alkaline solution to said cationic polyamide and heating said polyamide to form a covalent bond between said polyamide amino groups and said vinyl sulfone dye.

2. A process according to claim 1 wherein said vinyl sulfone dye optionally contains a second fiber reactive moiety selected from the group consisting of a vinyl sulfone substituent of the formula $—SO_2 CH{=}CH_2$, mono-halogen-striazine, a dihalogen-s-triazine or a monocyanamido-s-triazine.

3. A process according to claim 2 wherein said second fiber reactive moiety is a vinyl sulfone substituent of the formula $—SO_2 CH{=}CH_2$.

4. A process according to claim 2 wherein second fiber reactive moiety is a mono-chloro-s-triazine.

* * * * *